US005906344A

United States Patent [19]

Atkinson et al.

[11] Patent Number: 5,906,344

[45] Date of Patent: May 25, 1999

[54] FURNITURE FOOT ASSEMBLY

[75] Inventors: Leon Eric Atkinson, Asheboro; Gerald B. Zinnbauer, Cornelius, both of N.C.

[73] Assignee: Technimark, Inc., Asheboro, N.C.

[21] Appl. No.: 08/901,852

[22] Filed: Jul. 29, 1997

[51] Int. Cl.[6] ..... F16M 11/20

[52] U.S. Cl. ..... 248/188.9

[58] Field of Search ..... 248/188.9, 188, 248/615, 677, 346.11, 903; 108/25; 403/359, 334

[56] References Cited

U.S. PATENT DOCUMENTS

| | | | |
|---|---|---|---|
| 3,640,496 | 2/1972 | Duncan | 248/188.9 |
| 4,923,158 | 5/1990 | Saisho | 248/188.8 |
| 5,007,607 | 4/1991 | Kim | 248/615 X |
| 5,088,669 | 2/1992 | Zinnbauer | 248/188.9 |
| 5,312,078 | 5/1994 | Marsh | 248/903 X |
| 5,568,708 | 10/1996 | Kassardjian et al. | 248/188.8 X |
| 5,697,669 | 12/1997 | Yemini | 248/188.9 X |

OTHER PUBLICATIONS

PI, Inc. Advertisement; Undated, admitted prior art.

*Primary Examiner*—Ramon O. Ramirez
*Attorney, Agent, or Firm*—Rhodes Coats & Bennett L.L.P.

[57] ABSTRACT

A furniture foot assembly including a foot support block and an attachable furniture foot. The foot support block includes a substantially triangular-shaped body having rectangular outer walls joined together along at one of the end edges to form an intersection having an angle of about 90° corresponding to the angle between adjoining rails of an item of furniture. An elongated boss is aligned with the intersection and is adapted to receive a furniture foot having a stem. The elongated boss provides a sufficient area of contact between the stem of the furniture foot without adding unnecessary weight. In the preferred embodiment, a boss support structure is formed from a bottom wall and a plurality of radial supports attached to the outer walls and the elongated boss.

40 Claims, 3 Drawing Sheets

FURNITURE FOOT ASSEMBLY

BACKGROUND OF THE INVENTION (1) Field of the Invention

The present invention relates generally to furniture feet for sofas and the like and, more particularly, to a furniture foot assembly including a foot support block adapted to receive a furniture foot.

(2) Description of the Prior Art

The retail furniture business has become extremely competitive in recent years, especially in the high volume/low price realm, so manufacturers are constantly searching for ways to improve quality while reducing costs. Two methods often employed are material substitution and reduction of cube (volume) in shipping. While new materials can be substituted for internal components, little has been done to reduce cube in shipping because the products' standard size and image are usually not changeable.

One of the few places that both cost savings actions can be employed is in the feet used on such items as easy chairs and sofas. These feet have traditionally been wood but, in recent times, lower cost plastic feet have been substituted. The production and material costs for plastic feet are much lower on a per unit basis than wooden feet. In addition, plastic feet often can be added to the furniture more easily after it has been shipped, so that the cube of the shipped product is reduced. Also, because of the nature of plastic, a small shaft or stem can be formed at the top of the foot integrally with the body of the foot. This stem can be made sufficiently strong to be driven into holes in the furniture frame, thereby speeding up the assembly process.

A stem of similar small section cannot be formed in wood because it would be too weak to withstand the side pressure to which it would be exposed. In addition, it would not be resilient and have the memory to "grasp" the hole into which it is inserted. Accordingly, wooden feet often required the use of a metal threaded rod for attachment.

However, plastic feet have a tendency to loosen over time and drop out when the furniture is moved. This results in a perception of poor quality and customer dissatisfaction. Thus, there was a need for a plastic foot design that could be successfully driven into the furniture frame and not turn or work loose.

U.S. Pat. No. 5,088,669, issued to the Assignee of the present invention, substantially solved this problem by providing a furniture foot including a body and a specially designed stem having a hollow cross-section. The stem has a length greater than the thickness of a lower portion of an item of furniture and a diameter slightly larger than the diameter of a hole formed in the lower portion of the furniture. The stem extends through the hole so that the body of the foot is adjacent the lower portion. The lower portion of the furniture somewhat compresses the hollow stem within the hole to form a interference, frictional fit within the hole. This secures the foot in place on the lower portion of the furniture. In the preferred embodiment, the stem has a plurality of ribs which are either tapered or do not extend the full length of the stem, thereby allowing the ribs to be more easily pressed into the lower portion of the item of furniture and, in addition, which inhibit rotation of the foot in the hole. The entire disclosure of this patent is hereby incorporated by reference.

As discussed above, the lower portion of the furniture has generally been a wooden corner block attached between two perpendicular wooden rails forming one of the generally four corners of the item of furniture such as a sofa or easy chair. Plastic corner blocks offer some advantages such as a more consistently square corner frame but have generally been too costly because of the amount of material needed to provide the necessary strength to attach the plastic corner block to the frame and support the weight on the furniture foot. In addition, the amount of material needed can produce an unsightly edge along the bottom of the item of furniture. Finally, prior art plastic corner blocks often required barb nuts or the like to provide sufficient attachment of the threaded feet to the block. Not only do these items add cost, they are also difficult to repair when they occasionally come loose since the bottom covering of the item of furniture must be removed to reattach the foot to the corner block. One example of such a prior art corner block is an item FS952 available from the carv/craft® Division of PI, Inc. in Athens, Tenn.

Thus, there remains a need for a new and improved furniture foot assembly which is strong and lightweight and cost effective and does not produce an unsightly edge while, at the same time, does not use barb nuts or the like to provide sufficient attachment of the furniture foot.

SUMMARY OF THE INVENTION

The present invention is directed to a furniture foot assembly including a foot support block and an attachable furniture foot. The foot support block includes a substantially triangular-shaped body having rectangular outer walls, each wall having a top edge, a bottom edge and two end edges, the outer walls joined together along at one of the end edges to form an intersection having an angle of about 90°. This angle corresponds to the angle between adjoining rails of an item of furniture.

An elongated boss is substantially aligned with the intersection and is adapted to receive a furniture foot having a stem. The elongated boss provides a sufficient area of contact between the stem of the furniture foot without adding unnecessary weight. A support structure attached to the outer walls and the elongated boss connects the elongated boss to the outer walls. In the preferred embodiment, the support structure is formed from a bottom wall and a plurality of radial supports attached to the outer walls and the elongated boss.

The foot support block is adapted for use with a furniture foot having a body for ground engagement, a stem extending from the body and having a plurality of radially extending ribs thereon, whereby the stem may be inserted into the elongated boss so that the ribs engage the inside face of the elongated boss to secure the foot to the foot support block.

Accordingly, one aspect of the present invention is to provide a furniture foot assembly including a foot support block. The foot support block includes: (a) at least two rectangular outer walls, each wall having a top edge, a bottom edge and two end edges, the outer walls joined together along at one of the end edges to form an intersection having an angle of about 90°; (b) an elongated boss substantially aligned with the intersection and adapted to receive a furniture foot having a stem; and (c) a support structure attached to the outer walls and the elongated boss for connecting the elongated boss to the outer walls.

Another aspect of the present invention is to provide a furniture foot support block. The foot support block includes: (a) a substantially triangular-shaped body having rectangular outer walls, each wall having a top edge, a bottom edge and two end edges, the outer walls joined together along at one of the end edges to form an intersection having an angle of about 90°; (b) an elongated boss substantially aligned with the intersection and adapted to receive a furniture foot having a stem; and (c) a support structure attached to the outer walls and the elongated boss for connecting the elongated boss to the outer walls.

Still another aspect of the present invention is to provide a furniture foot assembly. The assembly includes: (a) a substantially triangular-shaped body having rectangular outer walls, each wall having a top edge, a bottom edge and two end edges, the outer walls joined together along at one of the end edges to form an intersection having an angle of about 90°; (b) an elongated boss substantially aligned with the intersection and adapted to receive a furniture foot having a stem; (c) a support structure attached to the outer walls and the elongated boss for connecting the elongated boss to the outer walls; and (d) a furniture foot having a body for ground engagement, a stem extending from the body and having a plurality of radially extending ribs thereon, whereby the stem may be inserted into the elongated boss so that the ribs engage the inside face of the elongated boss.

These and other aspects of the present invention will become apparent to those skilled in the art after a reading of the following description of the preferred embodiment when considered with the drawings.

DESCRIPTION OF THE PREFERRED EMBODIMENTS

Figure 3:
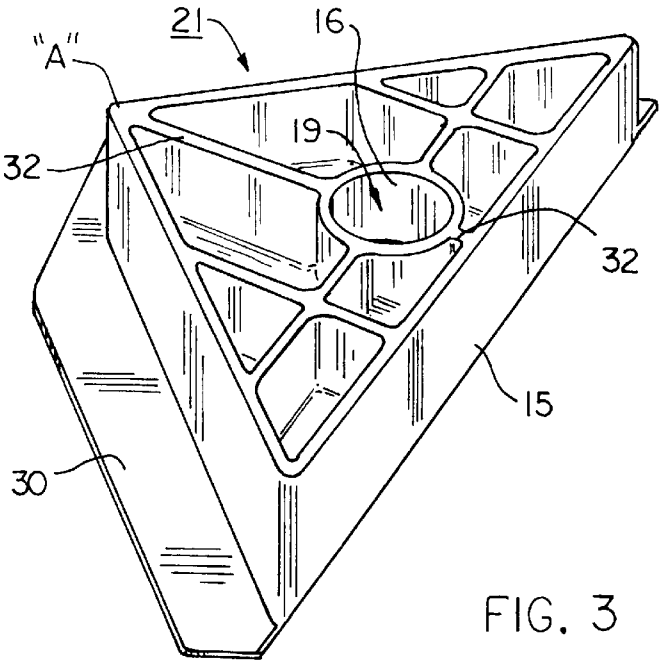
FIG. 3 is a perspective view of a foot support block constructed according to the present invention having a hole therein for receiving the furniture foot of FIG. 1.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general, it will be understood that the illustrations are for the purpose of describing a preferred embodiment of the invention and are not intended to limit the invention thereto. As best seen in FIGS. 4 and 6–8, a furniture foot assembly, generally designated 8, is shown constructed according to the present invention. The furniture foot assembly 8 includes two major sub-assemblies: a plastic foot support block 21; and a plastic furniture foot having an attachment stem adapted to be secured to the plastic foot support.

Figure 1:
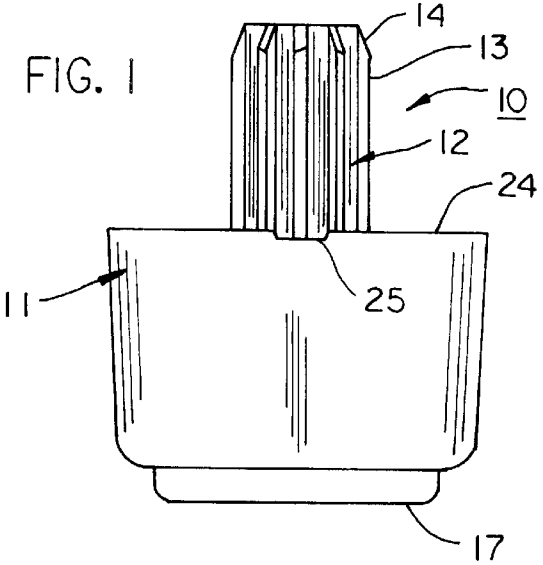
FIG. 1 is an elevational view of a furniture foot for use with a furniture foot support block constructed according to the present invention.
Figure 2:
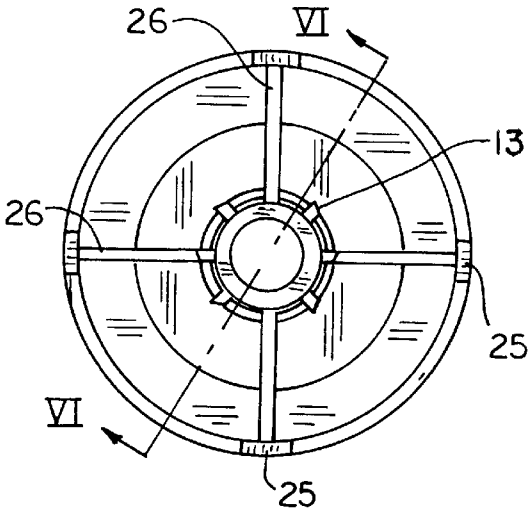
FIG. 2 is a top plan view of the furniture foot of FIG. 1.

The furniture foot, generally designated 10, is best seen in FIGS. 1 and 2. This foot and its use with wooden furniture frames is described in greater detail in U.S. Pat. No. 5,088,669.

The foot 10 may be constructed by plastic molding and made in one piece in the molding process. Making the foot as a unitary whole provides economy of manufacture while assuring maximum strength.

Foot 10 includes an outer body or visible shell 11 and a generally hollow stem or shaft 12. Body 11 is cup-shaped and includes radial webs 26 (see FIG. 2) connecting the stem 12 and the bottom and side walls of the cup. Stem 12 is meant to be inserted through an elongated boss 19 in a foot support block 21 constructed according to the present invention and depicted generally in FIG. 3.

Elongated boss 19 has an inside face 16. Since the boss 19 is elongated, it provides sufficient contact with the stem 12 to hold the foot in place without requiring unnecessary increases in the amount of plastic needed to mold the article. In the preferred embodiment, a plurality of radial supports 34 provide further strength. The foot support block 21 is preferably molded in one piece of plastic and may be molded from the same material as the furniture foot 10.

Figure 5:
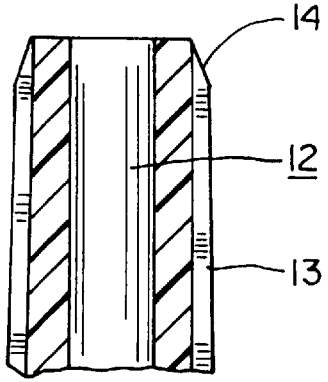
FIG. 5 is a sectional view through the stem of the furniture foot of FIG. 2 taken along lines VI—VI and looking in the direction of the arrows.

Because the stem 12 is generally slightly tapered to be molded as part of the body 11, ribs 13 are molded as part of the stem 12 in order to make a good contact with the sides of the elongated boss 19. A stem having the full diameter of elongated boss 19 could not easily be forced through the hole in the boss. However, since the distal ends of the ribs are either tapered or do not extend the full length of the stem, the ribs 13 can be more easily pressed into elongated boss 19 and are made to define a diameter slightly larger than elongated boss 19. Also, in the preferred embodiment, the stem 12 is made hollow, as seen in FIGS. 2 and 5. This saves some material and provides some "give" when the stem 12 is pressed into elongated boss 19.

As discussed above, in the preferred embodiment stem 12 has a lead-in bevel 14 to assist in its alignment with elongated boss 19. When the stem is aligned, body 11 is struck by a suitable heavy object, such as a rubber mallet, on its lower surface 17 until the upper surface 24 of the body 11 makes contact with lower surface 18 of the foot support block 21 and can go no further.

Figure 4:
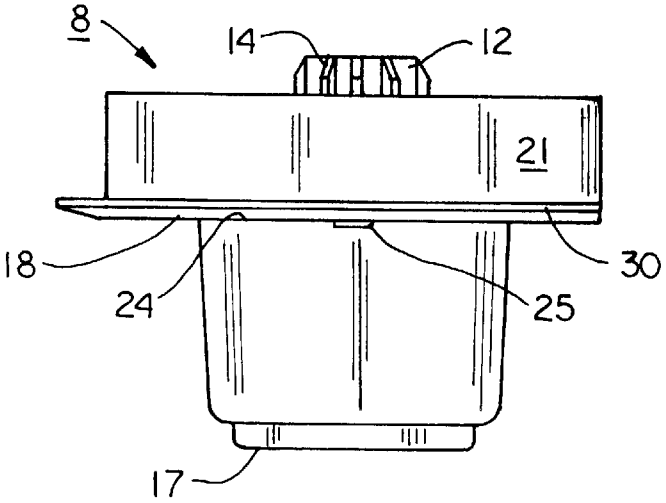
FIG. 4 is an elevational view of a furniture foot assembly including the furniture foot of FIG. 1 inserted into the foot support block of FIG. 3.

When the stem 12 is driven through elongated boss 19 to its maximum extent, as seen in FIG. 4, the ribs 13 grip into the surface 16 of the inside of elongated boss 19, since they extend radially further than elongated boss 19. When the stem 12 has been inserted fully, the natural memory of the stem and ribs conform tightly to the sides 16 of elongated boss 19. This conformation enables the foot 10 to remain securely attached to the foot support block 21.

If the foot 10 sustains sufficient side pressure or is in any way turned, then the helpful ribs 13 of the stem 12 could act as a ream to enlarge the elongated boss 19 and reduce the grip on the stem 12. This problem was more evident when the plastic foot was forced into a wooden hole but no longer appears as significant when both the foot 10 and foot support block 21 are formed from materials having similar properties. However, in the preferred embodiment of the furniture foot, as described in U.S. Pat. No. 5,088,669, the ribs 13 are provided with angled outer faces. The angled outer faces form an acute angle with one of the radial faces of the rib, and adjacent ribs have their acute angles oppositely oriented.

Thus, one rib helps to prevent clockwise rotation and another help to prevent counterclockwise rotation. Other asymmetrical profiles for the ribs 13 may be substituted as long as they inhibit rotation and are provided in opposite pairs to inhibit rotation in both directions.

Figure 6:
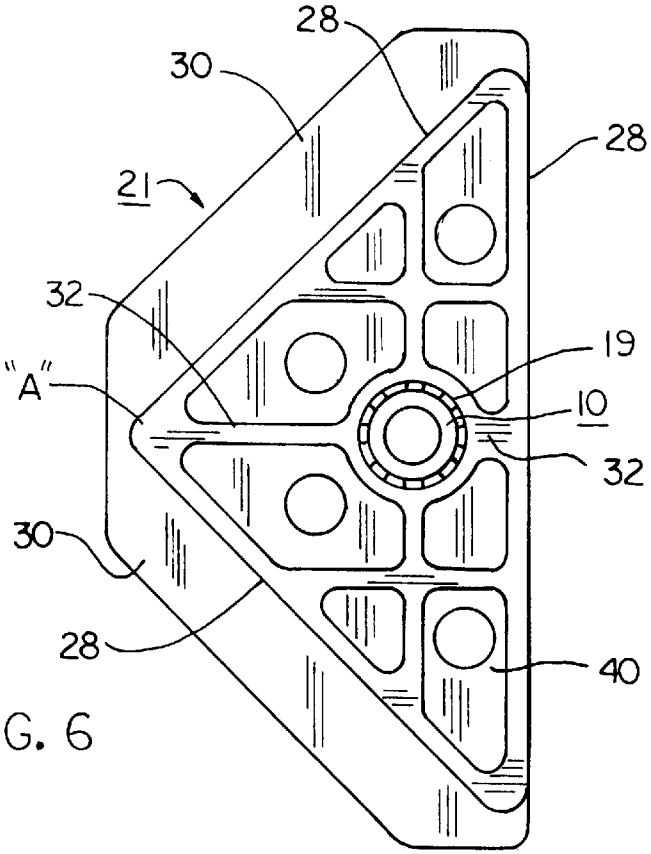
FIG. 6 is a top view of the furniture foot assembly shown in FIG. 4.

Also aiding in the snug fit of the furniture foot 10 to the foot support block 21 is the fact that stem 12 is hollow, like a tube, as shown in FIGS. 2 and 6. When the stem 12 is driven through the foot support block 21 as shown in FIG. 4, a portion of the stem 12 protrudes through the foot support block 21. As mentioned above, the ribs 13 extend radially to a greater extent than the diameter of elongated boss 19. As the stem 12 is driven through the elongated boss 19, its diameter is compressed slightly by the hole. When the compressed stem 12 passes beyond the constraining surface 16, it is again allowed to recover part of its original diameter, which is somewhat larger than the inside diameter of elongated boss 19. The restoration of the diameter is assisted by the fact that the foot 10 is made from a resilient plastic material which causes the foot 10 to be more securely held in the seated position.

While, in the preferred embodiment, the end of stem 12 does extend fully through the elongated boss 19, it is only necessary that the stem 12 extend far enough into the boss 19 to provide sufficient contact area between the stem and the surface 16 of the inside of elongated boss 19 to secure the foot 10 to the foot support block 21.

After insertion of the stem 12, there may be a need to remove the foot 10. Removal is greatly hindered because of the strong grip and secure hold of the foot support block 21 on stem 12. When it does become necessary to remove the foot 10, as in a moving activity for example, this can be accomplished as described in U.S. Pat. No. 5,088,669. Slots or gaps 25 are provided located over the webs 26. Into these slots 25 a small rigid blade, such as that of a screwdriver (see FIG. 6), can be inserted to pry the foot out of the elongated boss 19 in foot support block 21. Slots 25 are positioned over the webs 26 so that the rigid ribs can be used to pry against to remove the foot.

The preferred material for the foot 10 and foot support block 21 is a hard polyethylene, with a hardness of about 8 melt or lower. In addition, the preferred inside diameter of elongated boss 19 is about 0.750 inches and the preferred outside diameter of stem 12 is about 0.780 inches. While these dimensions can be varied as long as sufficient material remains in the stem 12 for strength, it has been found that the maximum outside diameter of the stem 12 should be no more than about 20 to 60 mils greater than the maximum inside diameter of elongated boss 19. In the preferred embodiment, the outside diameter of the stem is 30 mils greater than the inside diameter of the boss 19.

Turning now to FIG. 6, there is shown a top view of the furniture foot assembly shown in FIG. 4. As can be seen, the foot support block 21 is generally shaped to conform to the corner formed by the furniture rails 42. In the preferred embodiment, the foot support block 21 is triangularly-shaped including three outer walls 28 forming about a 90° angle at one corner "A". Locating flanges 30 extend along the length of the outer walls adjacent to corner "A". Their function will be further described in the description of FIG. 7.

A plurality of radial supports 32 extend between elongated boss 19 and walls 28 to support the boss and provide additional strength without unnecessarily increasing the weight or amount of material of the foot support block 21. In the preferred embodiment, locating flanges 30 are connected by bottom wall 36. When bottom wall 36 is present, it is not necessary that radial supports 32 extend all the way to walls 28 since bottom wall 36 can provide an attachment to support elongated boss 19 in addition to or in place of radial supports 32. Also, in the preferred embodiment, a plurality of openings 40 can be formed into bottom wall 36 for additional weight and material savings.

Figure 7:
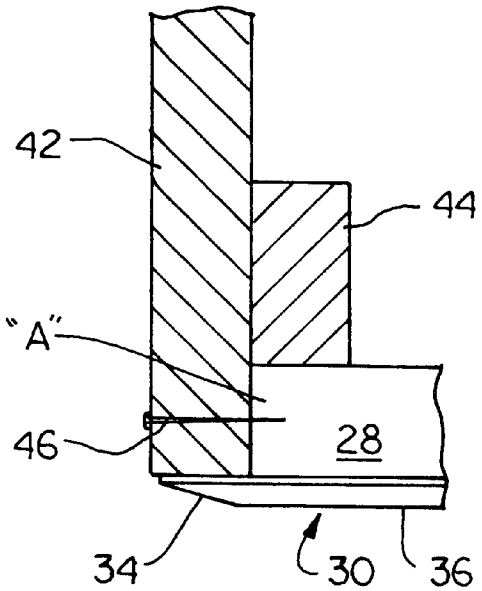
FIG. 7 is an enlarged fragmentary side view of the furniture foot assembly shown in FIG. 4 illustrating the low profile, tapered locating flanges and the relocated rail corner block.

FIG. 7 is an enlarged fragmentary side view of the furniture foot assembly shown in FIG. 4 illustrating the low profile, locating flanges 30 having a tapered edge 34 and a downwardly relocated rail corner block 44. Relocating the rail corner block 44 to where it contacts the upper edge of walls 28 at corner "A" permits the locating flanges to be much lighter in weight since most of the load between the foot support block 21 and the item of furniture is transferred to the furniture rails 42 by rail corner block 44. Thus, the outer edges 34 of the locating flanges 30 can be tapered to substantially eliminate the unsightly edge along the bottom of the item of furniture. In the preferred embodiment, the angle of the edge is between about 10° to 30° from the horizontal plane. When the relocated corner block is used, staples or brads 46 can be driven directly through rails 42 into the wall 28 of the foot support block 21 rather than through the bottom surface of locating flanges 30 as in the prior art.

Figure 8:
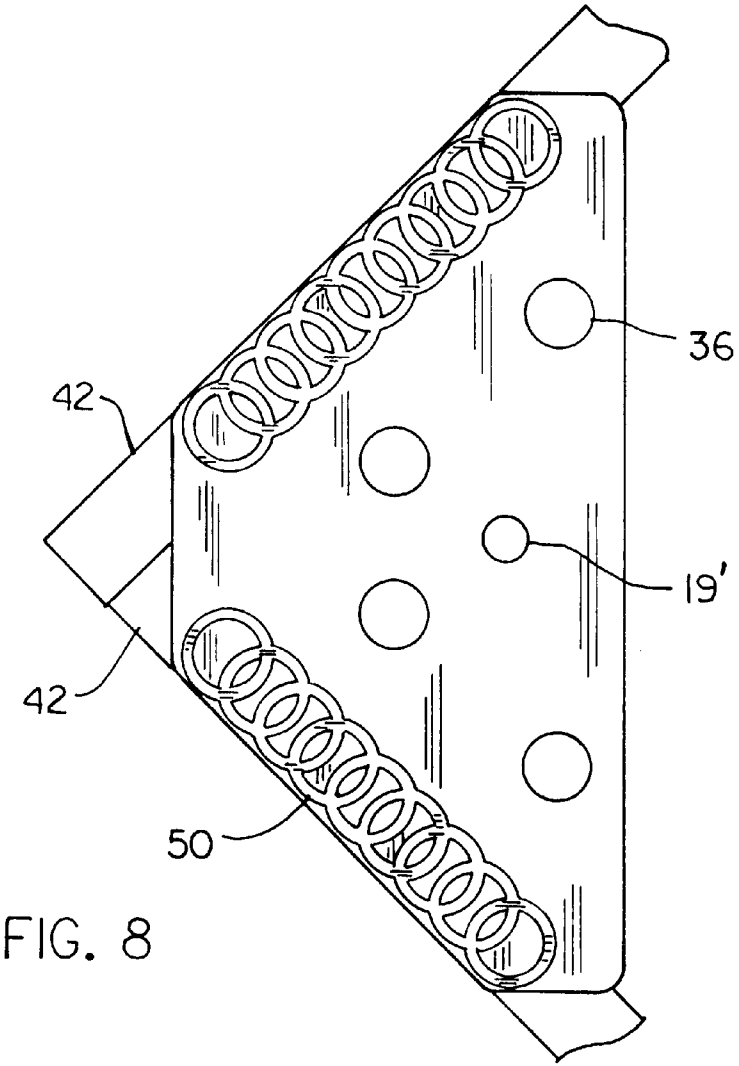
FIG. 8 is an enlarged fragmentary bottom view of an alternative embodiment of the locating flanges having a plurality of overlapping stable rings along its bottom edges.

Turning now to FIG. 8, there is shown an enlarged fragmentary bottom view of an alternative embodiment of the locating flanges having a plurality of overlapping staple rings 50 along its edges. These rings, each about ⅛" high, provide a crumple zone along the edges of locating flanges 30 which permits staples or brads 46 to be driven through the flanges into the bottom of rails 42 without unnecessary increasing the thickness of the flanges. This alternative embodiment can be used, for example, where the edges of the locating flanges 30 are not easily visible because of a fabric skirt, etc.

In operation, the foot support blocks 21 are positioned adjacent to the bottom of rails 42 in a partially constructed item of furniture. Staples or brads 46 are then driven directly through rails 42 into the wall 28 of the foot support block 21 or through the flanges into the bottom of rails 42 depending on the strength requirements of the particular item of furniture and, as may be the case, what type of locating flange is being used. The furniture foot 10 than can be installed at the factory or by the end user in a manner similar to that described in U.S. Pat. No. 5,088,669.

Certain modifications and improvements will occur to those skilled in the art upon a reading of the foregoing description. By way of example, while the elongated boss described above is adapted to receive a furniture foot having a plastic stem, it could also be threaded to receive a wooden or plastic foot having a threaded metal shaft or other mechanical interlocking designs could be created to attach a portion of the foot to the foot support block. It should be understood that all such modifications and improvements have been deleted herein for the sake of conciseness and readability but are properly within the scope of the following claims.

We claim:

1. A furniture foot assembly including a foot support block, said support block comprising:

(a) at least two rectangular outer walls, each wall having a top edge, a bottom edge and two end edges, said outer walls joined together along at one of said end edges to form an intersection having an angle of about 90°;

(b) an elongated boss substantially aligned with said intersection and adapted to receive a furniture foot having a stem, said stem being coupled and secured within said elongated boss; and (c) a support structure attached to said outer walls and said elongated boss for connecting said elongated boss to said outer walls.

2. The assembly according to claim 1, further including a furniture foot having a body for ground engagement, a stem, extending from said body and having a plurality of radially extending ribs thereon, whereby said stem may be inserted into the elongated boss so that said ribs engage the inside face of the elongated boss.

3. The assembly-according to claim 2, wherein said stem has a beveled distal portion to assist in centering said stem in the elongated boss during insertion.

4. The assembly according to claim 2, wherein said ribs are tapered.

5. The assembly according to claim 2, wherein said stem is hollow.

6. The assembly according to claim 2, wherein said body, stem and ribs are unitary and formed of molded plastic.

7. The assembly according to claim 2, wherein said ribs have a hardness of at least about the hardness of 8 melt polyethylene.

8. The assembly according to claim 2, wherein said body is cup-shaped with an inside center and rim with said stem extending upward from the inside center.

9. The assembly according to claim 8, wherein said cup-shaped body has a side wall and a radial web extending from said stem to said side wall and said rim has a slot aligned with said radial web so that the insertion of a tool into said slot facilitates prying the extremity from said elongated boss.

10. The assembly according to claim 2, wherein said stem has a length greater than the length of said elongated boss and a diameter slightly larger than the inside diameter of said elongated boss, said stem diameter being substantially uniform along the entire stem length except perhaps for an enlarging taper towards the body, and extending through said elongated boss so that the body of the foot is adjacent said elongated boss and a length of said stem extends above said elongated boss whereby said elongated boss compresses said stem within said elongated boss to secure the foot in place.

11. The assembly according to claim 10, wherein said stem has a beveled distal portion to assist in centering said stem in the elongated boss during insertion.

12. A furniture foot support block, said support block comprising:

(a) a substantially triangular-shaped body having rectangular outer walls, each wall having a top edge, a bottom edge and two end edges, said outer walls joined together along at one of said end edges to form an intersection having an, angle of about 90°;

(b) an elongated boss substantially aligned with said intersection and adapted to receive a furniture foot having a stem said stem being coupled and secured within said elongated boss; and (c) a support structure attached to said outer walls and said elongated boss for connecting said elongated boss to said outer walls.

13. The support block according to claim 12, wherein elongated boss is cylindrically-shaped with a circular cross-section.

14. The support block according to claim 12, wherein said support structure is a bottom wall.

15. The support block according to claim 12, wherein said support structure is a plurality of radial supports attached to said outer walls and said elongated boss.

16. The support block according to claim 12, wherein said support structure is a bottom wall and a plurality of radial supports attached to said outer walls and said elongated boss.

17. The support block according to claim 12, wherein said support structure is a bottom wall and a plurality of radial supports attached to said bottom wall and said elongated boss.

18. The support block according to claim 12, further including at least one locating flange attached along the bottom edge of one of said outer walls.

19. The support block according to claim 18, wherein the outer edge of said locating flange is tapered.

20. The support block according to claim 18, wherein the bottom surface of the outer edge of said locating flange includes a crumple zone along the edge of the locating flange, thereby permitting staples or brads to be driven through the flange without unnecessary increasing the thickness of the flange.

21. The support block according to claim 20, wherein said crumple zone includes a plurality of overlapping staple rings.

22. A furniture foot assembly, said assembly comprising:

(a) a substantially triangular-shaped body having rectangular outer walls, each wall having a top edge, a bottom edge and two end edges, said outer walls joined together along at one of said end edges to form an intersection having an angle of about 90°, (b) an elongated boss substantially aligned with said intersection and adapted to receive a furniture foot having a stem, sad stem being coupled and secured within said elongated boss;

(c) a support structure attached to said outer walls and said elongated boss for connecting said elongated boss to said outer walls; and (d) a furniture foot having a body for ground engagement, a stem extending from said body and having a plurality of radially extending ribs thereon, whereby said stem may be inserted into the elongated boss so that said ribs engage the inside face of the elongated boss.

23. The assembly according to claim 22, wherein said stem has a beveled distal portion to assist in centering said stem in the elongated boss during insertion.

24. The assembly according to claim 22, wherein said ribs are tapered.

25. The assembly according to claim 22, wherein said stem is hollow.

26. The assembly according to claim 22, wherein said body, stem and ribs are unitary and formed of molded plastic.

27. The assembly according to claim 22, wherein said ribs have a hardness of at least about the hardness of 8 melt polyethylene.

28. The assembly according to claim 22, wherein said body is cup-shaped with an inside center and rim with said stem extending upward from the inside center.

29. The assembly according to claim 28, wherein said cup-shaped body has a side wall and a radial web extending from said stem to said side wall and said rim has a slot aligned with said radial web so that the insertion of a tool into said slot facilitates prying the extremity from said elongated boss.

30. The assembly according to claim 22, wherein said stem has a length greater than the length of said elongated boss and a diameter slightly larger than the inside diameter of said elongated boss, said stem diameter being substantially uniform along the entire stem length except perhaps for an enlarging taper towards the body, and extending through said elongated boss so that the body of the foot is adjacent said elongated boss and a length of said stem extends above said elongated boss whereby said elongated boss compresses said stem within said elongated boss to secure the foot in place.

31. The assembly according to claim 30, wherein said stem has a beveled distal portion to assist in centering said stem in the elongated boss during insertion.

32. The assembly according to claim 22, wherein elongated boss is cylindrically-shaped with a circular cross-section.

33. The assembly according to claim 22, wherein said support structure is a bottom wall.

34. The assembly according to claim 22, wherein said support structure is a plurality of radial supports attached to said outer walls and said elongated boss.

35. The assembly according to claim 22, wherein said support structure is a bottom wall and a plurality of radial supports attached to said outer walls and said elongated boss.

36. The assembly according to claim 22, wherein said support structure is a bottom wall and a plurality of radial supports attached to said bottom wall and said elongated boss.

37. The assembly according to claim 22, further including at least one locating flange attached along the bottom edge of one of said outer walls.

38. The assembly according to claim 37, wherein the outer edge of said locating flange is tapered.

39. The assembly according to claim 37, wherein the bottom surface of the outer edge of said locating flange includes a crumple zone along the edge of the locating flange, thereby permitting staples or brads to be driven through the flange without unnecessary increasing the thickness of the flange.

40. The assembly according to claim 39, wherein said crumple zone includes a plurality of overlapping staple rings.

* * * * *